US009435614B2

(12) United States Patent
Beck

(10) Patent No.: US 9,435,614 B2
(45) Date of Patent: Sep. 6, 2016

(54) BALLISTIC VEST SYSTEM WITH BALLISTIC VEIN COMPONENT

(71) Applicant: TYR TACTICAL, LLC, Peoria, AZ (US)

(72) Inventor: Jason Beck, Peoria, AZ (US)

(73) Assignee: Tyr Tactical, LLC, Peoria, AZ (US)

( * ) Notice: Subject to any disclaimer, the term of this patent is extended or adjusted under 35 U.S.C. 154(b) by 0 days.

(21) Appl. No.: 14/497,486

(22) Filed: Sep. 26, 2014

(65) Prior Publication Data

US 2015/0082503 A1 Mar. 26, 2015

Related U.S. Application Data

(60) Provisional application No. 61/883,121, filed on Sep. 26, 2013.

(51) Int. Cl.
*F41H 1/02* (2006.01)

(52) U.S. Cl.
CPC ..... *F41H 1/02* (2013.01)

(58) Field of Classification Search
CPC ..... F41H 1/02; F41H 5/05; A42B 1/00; A41D 13/00
USPC ..... 2/2.5, 455, 459, 461, 462, 463, 467, 92; 89/36.05, 36.02, 36.01
See application file for complete search history.

(56) References Cited

U.S. PATENT DOCUMENTS

| | | | | |
|---|---|---|---|---|
| 3,577,836 | A * | 5/1971 | Tamura | 2/2.5 |
| 4,830,245 | A | 5/1989 | Arakaki | |
| 6,295,648 | B2 * | 10/2001 | Siman-Tov et al. | 2/2.5 |
| 6,481,015 | B1 * | 11/2002 | Lanier | 2/2.5 |
| 8,327,462 | B2 * | 12/2012 | Feldman et al. | 2/2.5 |
| 2010/0212056 | A1 * | 8/2010 | Sullivan | 2/2.5 |
| 2012/0167290 | A1 | 7/2012 | Kovacevich et al. | |
| 2012/0180179 | A1 * | 7/2012 | Lee et al. | 2/2.5 |
| 2012/0216324 | A1 * | 8/2012 | Medwell | 2/2.5 |
| 2012/0246788 | A1 * | 10/2012 | Harrell et al. | 2/2.5 |
| 2015/0082503 | A1 * | 3/2015 | Beck | 2/2.5 |

FOREIGN PATENT DOCUMENTS

| | | | |
|---|---|---|---|
| CA | 1131401 | C | 9/1982 |
| CA | 2454188 | A1 | 10/2004 |
| EP | 1 469 275 | A1 | 10/2004 |

OTHER PUBLICATIONS

European Search Report issued Jan. 22, 2015 in corresponding European patent application No. 14186616.0.

Australian Patent Examination Report No. 1 for Patent Application 2014233550, dated Jun. 30, 2015, 3 pages.

(Continued)

*Primary Examiner* — Gloria Hale
(74) *Attorney, Agent, or Firm* — Polsinelli PC

(57) ABSTRACT

Embodiments of ballistic vest system including a ballistic vest having a soft body armor component with a ballistic vein component positioned behind and adjacent the soft armor component for providing structural support to the ballistic vest and provide further dissipation of forces generated by the impact of a ballistic projectile and/or shrapnel against the soft body armor component. Other embodiments of a ballistic vest system having a ballistic vein component may be described and claimed.

18 Claims, 5 Drawing Sheets

(56) References Cited

OTHER PUBLICATIONS

Response to Search Report, in corresponding European Patent App No. 14186616.0, filed Oct. 1, 2015.

Office Action, in corresponding Canadian Application No. 2,864,804, issued Sep. 16, 2015, 5 pages.

* cited by examiner

BALLISTIC VEST SYSTEM WITH BALLISTIC VEIN COMPONENT

CROSS REFERENCE TO RELATED APPLICATIONS

This patent application claims benefit to U.S. provisional patent application Ser. No. 61/883,121 filed on Sep. 26, 2013 and is herein incorporated by reference in its entirety.

FIELD

The present disclosure relates to ballistic vest systems, and in particular, to ballistic vest systems having a ballistic vein component positioned behind a soft body armor component of the ballistic vest system for providing additional protection against ballistic projectiles and shrapnel.

BACKGROUND

A ballistic vest is an item of personal armor that assists in absorbing the impact from firearm-fired projectiles and shrapnel from explosions, and is usually worn around the torso of an individual. Ballistic vests may include soft body armor made from multiple layers of woven or laminated fibers that absorb the impact of the firearm-fired projectile and/or shrapnel. Although soft body armor may be suitable to protect the individual from many firearm-fired ballistic projectiles, there is always a need for improvements in ballistic vests having soft body armor, especially in protecting the extremities of an individual such as the deltoid/bicep area, yoke area, collar area, neck area, etc.

BRIEF DESCRIPTION OF THE DRAWINGS

Corresponding reference characters indicate corresponding elements among the various views of the drawings. The headings used in the figures do not limit the scope of the claims.

DESCRIPTION

Figure 1:
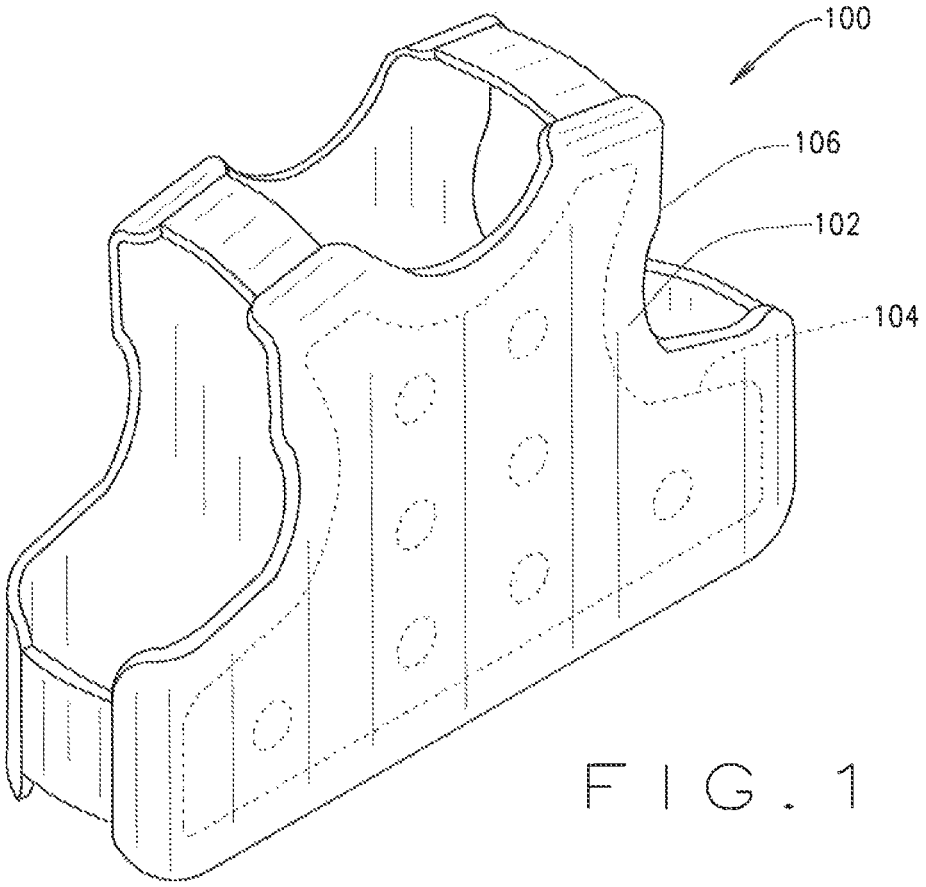
FIG. 1 is a perspective view of a ballistic vest system having a ballistic vest that covers and encases a soft body armor component and a ballistic vein component (shown in phantom)

As described herein, embodiments of a ballistic vest system comprising a ballistic vest with a soft body armor component and a ballistic vein component positioned directly behind and adjacent to the soft body armor component to enhance the overall ballistic performance of the ballistic vest system. In particular, the ballistic vein component provides structural support and protection against the impact of ballistic projectiles or shrapnel against the soft body armor component, especially along the extremities of an individual, such as the deltoid/bicep area, collar area, yoke area, neck area, etc. In addition, the ballistic vein component prevents sagging of the ballistic vest as well as promotes the structural integrity of the ballistic vest.

Referring to the drawings, embodiments of a ballistic vest system are illustrated and generally indicated as 100, 200 and 300 in FIGS. 1-9. In one embodiment shown in FIGS. 1-4, a ballistic vest system, designated 100, may include a ballistic vest 106 configured to be worn by an individual. In addition, the ballistic vest 106 may define an internal pocket (not shown) configured to receive a soft body armor component 102 shaped to cover and protect the torso and/or chest area of an individual wearing the ballistic vest 106. In some embodiments, the ballistic vest 106 may be made from a durable, wear resistant composite fabric material, such as a woven fabric material, a nylon material, a Kevlar® material and/or a combination thereof. For example, the composite fabric material may have a front layer made from a high performance nylon that may be laminated with a back layer made from high tenacity polymer fibers, such as various aramid fibers and high performance polyethylene fibers and the like. In some embodiments, the ballistic vest 106 may be configured to cover the extremities of an individual wearing the ballistic vest 106, such as the deltoid/bicep area, neck area, yoke area, collar area, etc.

In addition, the ballistic vest system 100 may include a ballistic vein component 104 disposed within the ballistic vest 106 and positioned directly behind the soft body armor component 102. In one aspect, the ballistic vein component 104 provides an additional protective layer directly behind the soft body armor component 102 that further dissipates and spreads out the forces generated by the impact of a ballistic projectile and/or shrapnel against the soft body armor component 102. In another aspect, the ballistic vein component 104 provides a structural component and framework to the ballistic vest 106 that is exterior to the soft body armor component 102 and provides structural integrity and prevents sagging of the ballistic vest 106.

Figure 4:
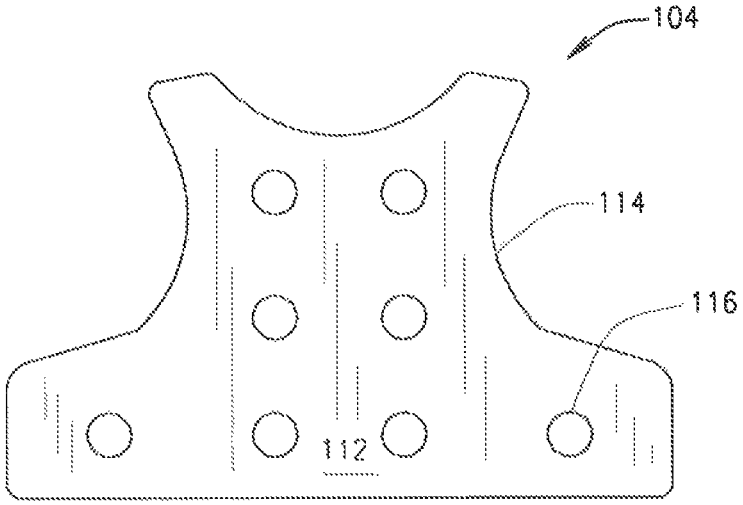
FIG. 4 is a rear view of the ballistic vein component of FIG. 3.
Figure 6:
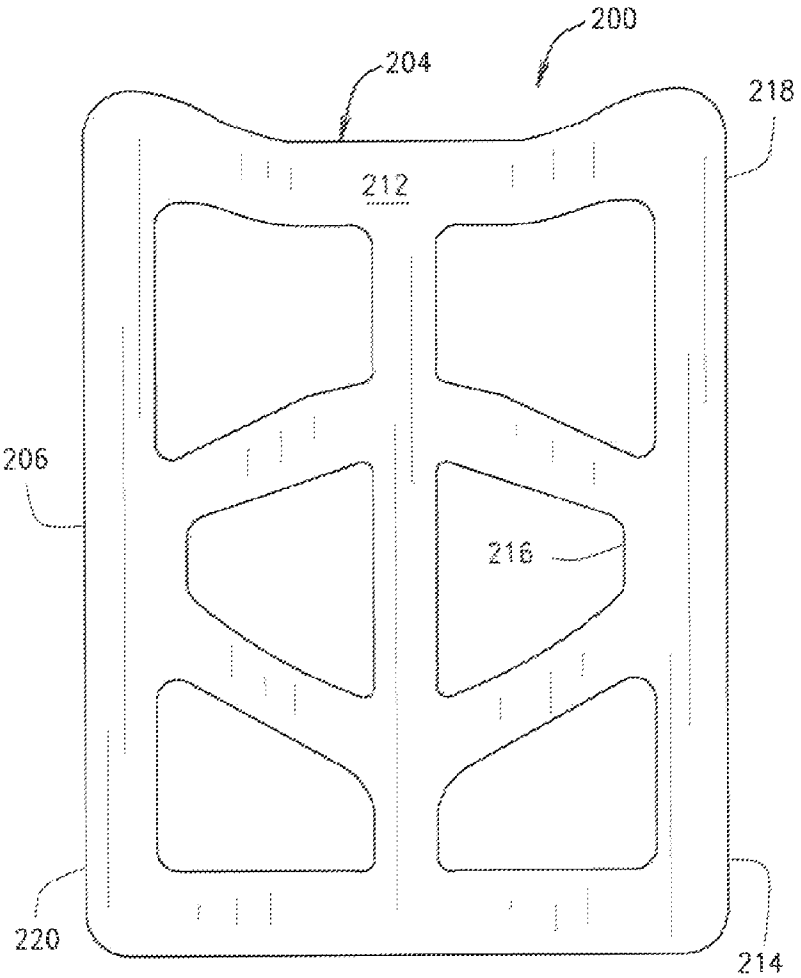
FIG. 6 is a rear view of the ballistic vein component of FIG. 5.
Figure 5:
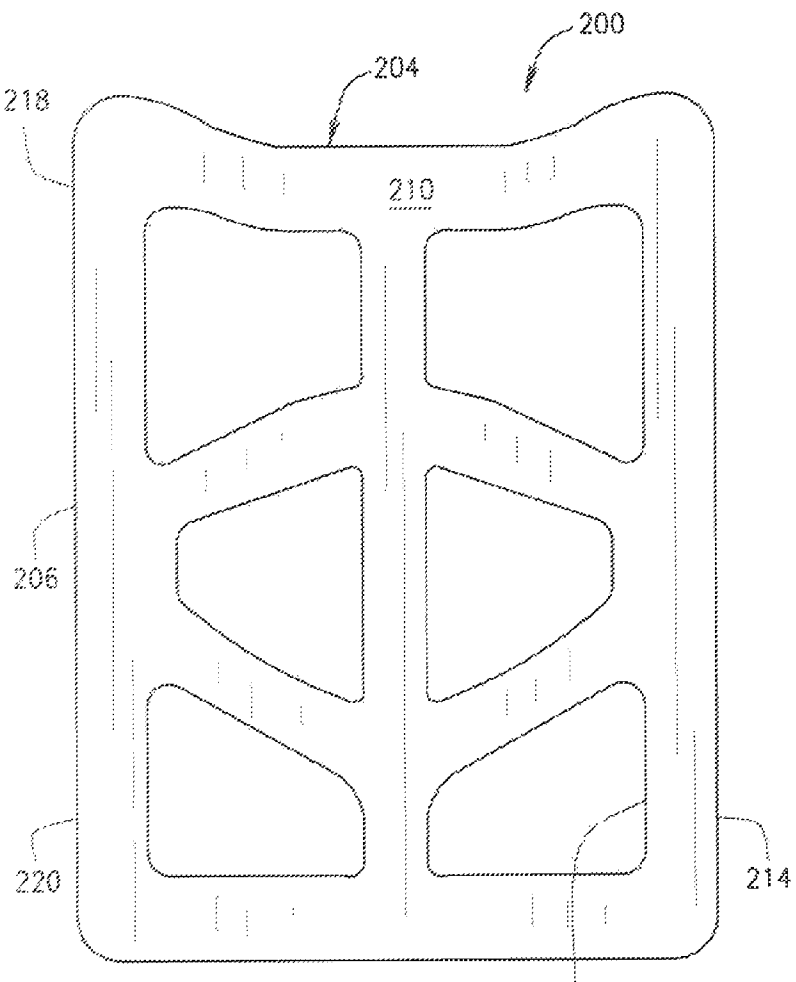
FIG. 5 is a front view of a second embodiment of a ballistic vein component.

In some embodiments, the ballistic vein component 104 has a generally planar-shaped body 108 defined by a front surface 110, a rear surface 112, and a peripheral edge 114. In some embodiments, the ballistic vein component 104 may define one or more openings 116 formed through the planar-shaped body 108, while in other embodiments the ballistic vein component 104 may have a planar-shaped body 108 of solid construction with no openings 116. As shown in FIGS. 4-6, in some embodiments the plurality of openings 116 may have different configurations, arrangements, and numbers. Non-limiting examples of configurations may be an asymmetrical-shaped configuration, a symmetrical-shaped configuration, a circular-shaped configuration, a square-shaped configuration, a rectangular-shaped configuration, a hexagonally-shaped configuration, a star-shaped configuration, or a rectangular-shaped configuration. In some embodiments, the ballistic vein component 104 may be configured to substantially cover the entire surface area of the soft body armor component 102.

Figure 2:
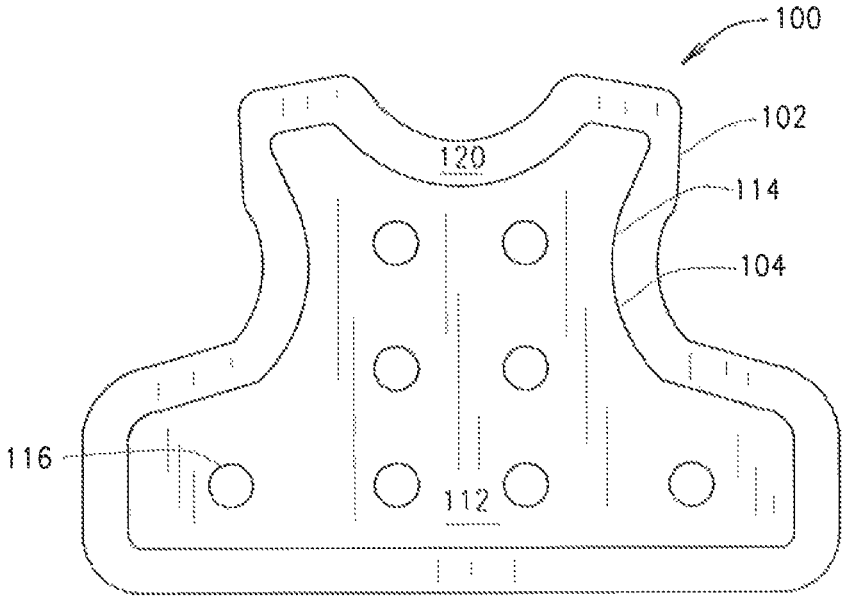
FIG. 2 is a rear view of the ballistic vein component positioned behind the soft body armor component during assembly of the ballistic vest system.
Figure 3:
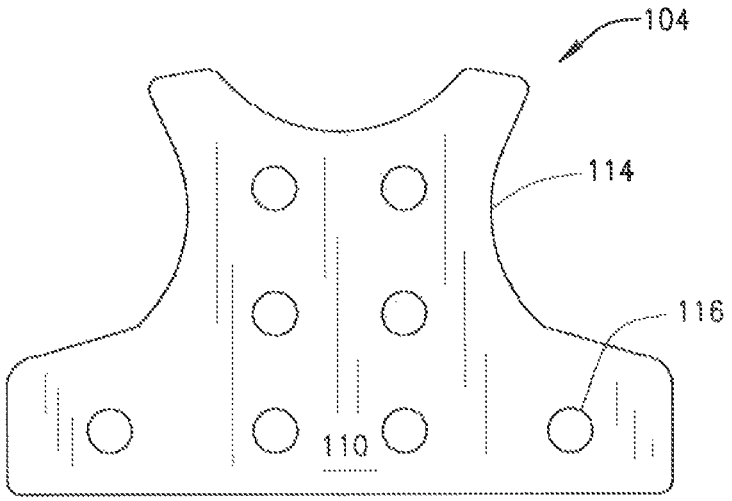
FIG. 3 is a front view of a first embodiment of the ballistic vein component.

In some embodiments, the ballistic vein component 104 may be configured to substantially cover the soft body armor component 102 to accommodate different shapes and sizes. For example, as shown in FIG. 2, the ballistic vein component 104 may be configured to substantially cover the chest and torso areas of an individual wearing the ballistic vest 106. In other embodiments the ballistic vein component 102 may be configured to substantially cover only the chest area of an individual. In some embodiments, the planar-shaped body 108 of the ballistic vein component 104 may be configured to substantially cover the extremities of an individual, such as the deltoid/bicep area, neck area, yoke area, collar area, etc.

As shown in FIGS. 5 and 6, a second embodiment of a ballistic vest system, designated 200, may include a ballistic vein component 204 having a generally planar-shaped body 206 defining a front surface 210, a rear surface 212 and a peripheral edge 214. In some embodiments, the peripheral edge 214 may form a curved-shaped upper portion 218 and a square-shaped lower portion 220 configured to substantially cover the chest area of an individual wearing the ballistic vest 108 (FIG. 1). In some embodiments, the ballistic vein component 204 may define a plurality of openings 216 formed through the planar-shaped body 206.

Figure 8:
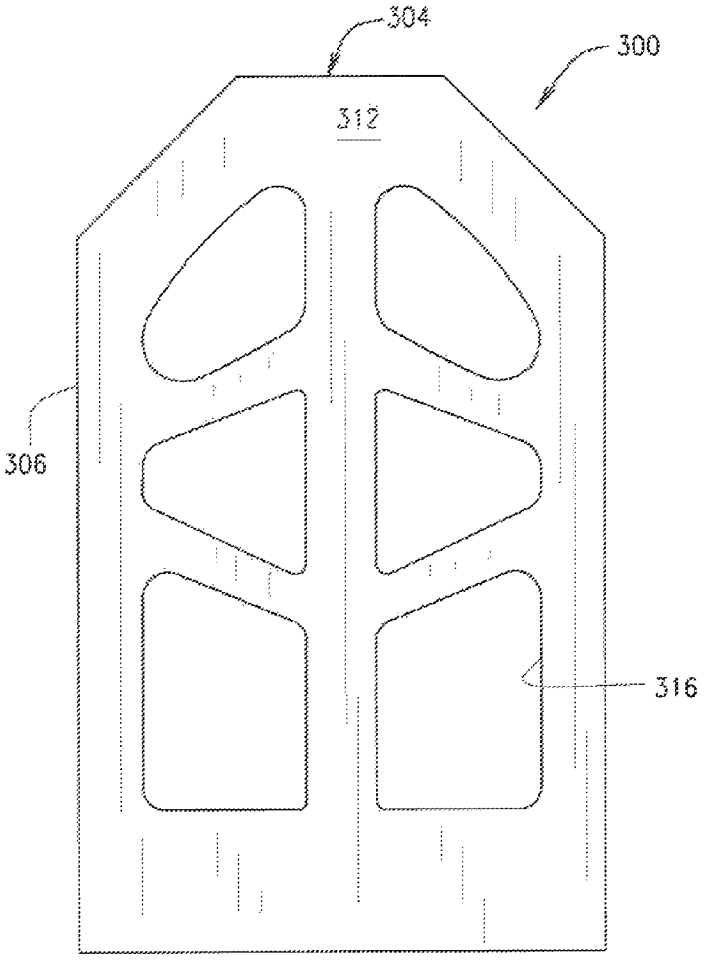
FIG. 8 is a rear view of the ballistic vein component of FIG. 7.
Figure 7:
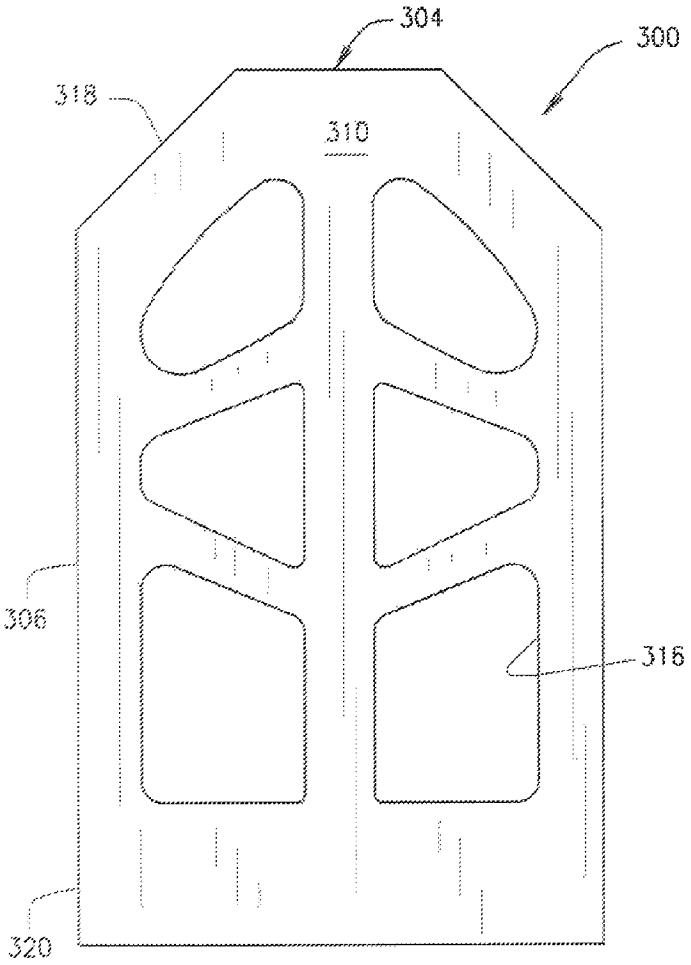
FIG. 7 is a front view of a third embodiment of a ballistic vein component.

As shown in FIGS. 7 and 8, a third embodiment of a ballistic vest system, designated 300, may include a ballistic vein component 304 having a generally planar-shaped body 306 defining a front surface 310, a rear surface 312 and a peripheral edge 314. In some embodiments, the peripheral edge 314 forms a tapered upper portion 318 and a square-shaped lower portion 320 configured to cover the chest area of an individual wearing the ballistic vest 108 (FIG. 1). In some embodiments, the planar-shaped body 306 may define a plurality of openings 316 having different configurations, while in other embodiments the plurality of openings 316 may have the same configuration.

Figure 9:
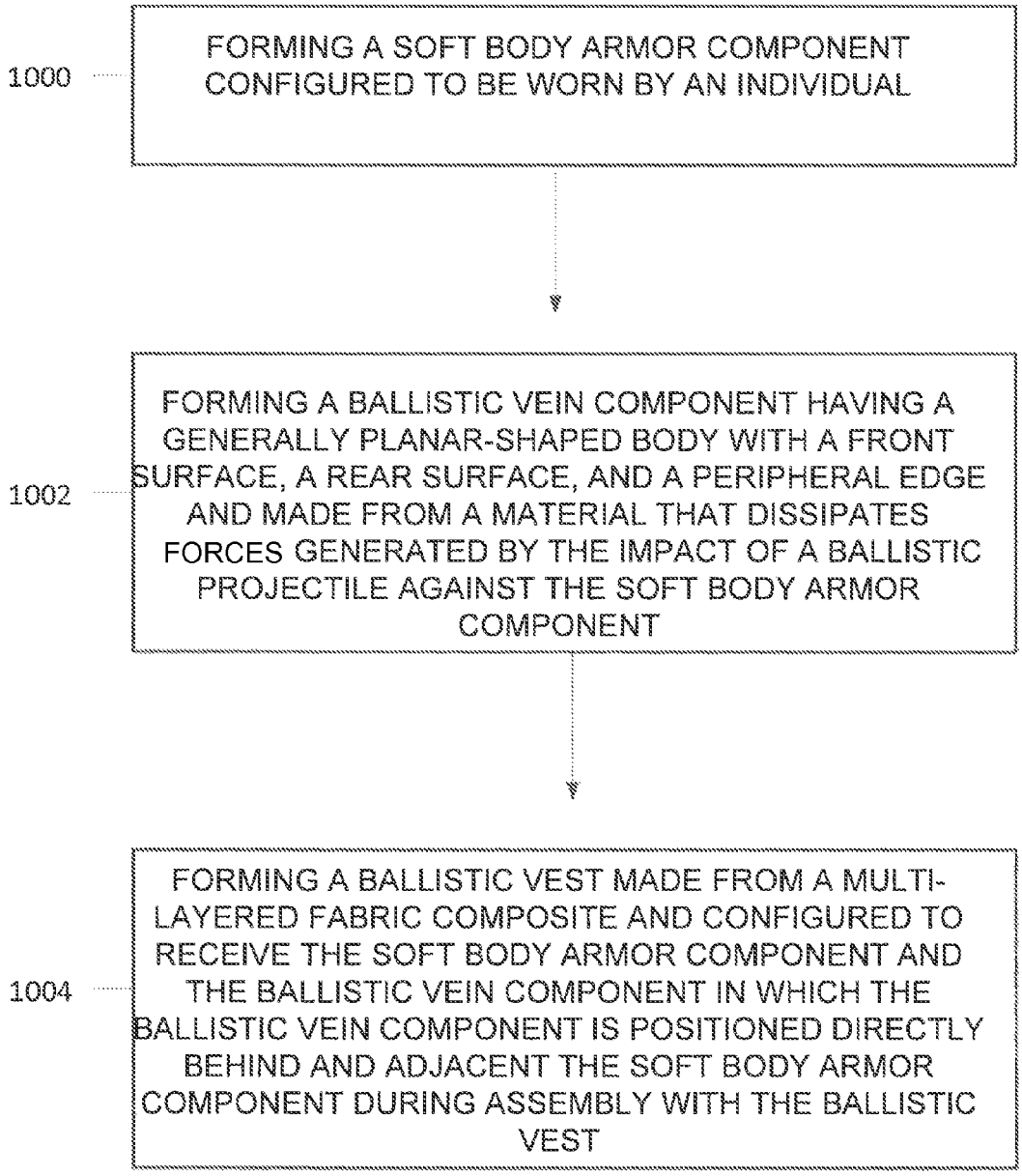
FIG. 9 is a flow chart illustrating one method for manufacturing the ballistic vest system including the ballistic vein component of FIG. 1.

Referring to FIG. 9, a flow chart illustrates one method for manufacturing one embodiment of the ballistic vest system 100. At block 1000, forming a soft body armor component 102 configured to be worn by an individual. At block 1002, forming a ballistic vein component 104 having a generally planar-shaped body with a front surface, a rear surface and a peripheral edge and made from a material, such as one or more of a polyethylene material, an ABS material and/or an aramid material, that dissipates forces generated by the impact of a ballistic projectile against the soft body armor component 102. At block 1004, forming a ballistic vest made from a multi-layered fabric composite material and configured to receive the soft body armor component 102 and the ballistic vein component 104 in which the ballistic vein component 104 is positioned directly behind and adjacent the soft body armor component 102 when the ballistic vest system 100 is assembled.

In some embodiments, the ballistic vein component 102 may be made from at least one of a polyethylene material, an ABS plastic material, a material made of Kevlar® and/or an aramid fiber material.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A ballistic vest system comprising:

a ballistic vest having a pocket;

a soft body armor component within the pocket of the ballistic vest for dissipating the force generated by the impact of a ballistic projectile; and a framework to the ballistic vest that is exterior to the soft body armor component and provides structural integrity to and prevents sagging of the ballistic vest, the framework having a body defined by a front surface, a rear surface, and a peripheral edge, the body of the framework positioned adjacent to the soft body armor component within the pocket of the ballistic vest, the body of the framework made from a material that further dissipates the force generated by the impact of the ballistic projectile against the soft body armor component.

2. The ballistic vest system of claim 1, wherein the material of the body of the framework comprises at least one of a polyethylene material, an ABS plastic material, and an aramid fiber material.

3. The ballistic vest system of claim 1, wherein the body of the framework is of a same shape as the soft body armor component.

4. The ballistic vest system of claim 1, wherein the body of the framework is positioned within the pocket behind and adjacent the soft body armor component.

5. The ballistic vest system of claim 1, wherein the ballistic vest is made from a composite fabric material comprising an outer layer made from a high performance nylon laminated with an inner layer made from high tenacity polymer fibers.

6. The ballistic vest system of claim 5, wherein the high tenacity polymer fibers comprise various aramid fibers and polyethylene fibers.

7. The ballistic vest system of claim 1, wherein the body of the framework defines one or more openings.

8. The ballistic vest system of claim 1, wherein the body of the framework is of solid construction with no openings.

9. The ballistic vest system of claim 1, wherein the body of the framework is configured to cover the extremities of an individual wearing the ballistic vest.

10. The ballistic vest system of claim 1, wherein the ballistic vest is configured to cover at least one of a deltoid/bicep area, or neck area, of an individual wearing the ballistic vest.

11. A tactical apparatus comprising:

a ballistic vest having a first side and a second side forming an interior;

a soft body armor component disposed within the interior of the ballistic vest; and a framework having a body providing a support to the ballistic vest that is exterior to the soft body armor component, the body disposed within the interior of the ballistic vest adjacent to the soft body armor component, the body made from a ballistics force dissipating material.

12. The tactical apparatus of claim 11, wherein the body is disposed within the interior between the first side and the soft body armor.

13. The tactical apparatus of claim 11, wherein the body is disposed within the interior between the second side and the soft body armor.

14. The tactical apparatus of claim 11, wherein the body is made from at one of: a polyethylene material, an ABS plastic material, or an aramid fiber material.

15. The tactical apparatus of claim 11, wherein at least one of the first side or the second side comprises an outer layer made from a high performance nylon laminated with an inner layer made from high tenacity polymer fibers.

16. The tactical apparatus of claim 15, wherein the high tenacity polymer fibers comprise one or more aramid fibers and polyethylene fibers.

17. The tactical apparatus of claim 11, wherein the body is planar.

18. The tactical apparatus of claim 17, wherein the body has one or more openings defined therein.

* * * * *